US007401557B2

(12) United States Patent
Feix et al.

(10) Patent No.: US 7,401,557 B2
(45) Date of Patent: Jul. 22, 2008

(54) SUPPORT FOR FUNCTIONAL PLANES

(75) Inventors: Jürgen Feix, Germering (DE); Roman Brylka, Wolfratshausen (DE)

(73) Assignee: CBP Guideway Systems GmbH, Germering (DE)

( * ) Notice: Subject to any disclaimer, the term of this patent is extended or adjusted under 35 U.S.C. 154(b) by 360 days.

(21) Appl. No.: 10/534,527

(22) PCT Filed: Nov. 14, 2003

(86) PCT No.: PCT/EP03/12740

§ 371 (c)(1),
(2), (4) Date: May 11, 2005

(87) PCT Pub. No.: WO2004/044329

PCT Pub. Date: May 27, 2004

(65) Prior Publication Data

US 2006/0016366 A1 Jan. 26, 2006

(30) Foreign Application Priority Data

Nov. 14, 2002 (DE) ..... 102 53 136

(51) Int. Cl.
*B60L 13/00* (2006.01)

(52) U.S. Cl. ..... 104/281; 104/286

(58) Field of Classification Search ..... 104/286, 104/281, 282, 124, 125, 294, 290; 310/13, 310/14; 318/135
See application file for complete search history.

(56) References Cited

FOREIGN PATENT DOCUMENTS

| | | | |
|---|---|---|---|
| DE | 3928277 C1 | | 12/1990 |
| DE | 4306166 A1 | | 9/1994 |
| DE | 19619867 A1 | | 11/1997 |
| DE | 19734471 | | 2/1998 |
| DE | 19735471 C1 | | 1/1999 |
| DE | 19931367 | | 1/2001 |
| DE | 19931367 A1 | | 1/2001 |
| DE | 19945749 | | 12/2001 |
| DE | 29724627 | | 8/2002 |
| EP | 0 987 370 | * | 3/2000 |
| EP | 0987370 A1 | | 3/2000 |
| WO | 199104375 A1 | | 4/1991 |

OTHER PUBLICATIONS

09037413 A, JP Abstract—Magnetic Rail Fitting Mechanism in Magnetic Levitation Moving System, Feb. 1997.*

English translation of International Preliminary Examination Report, PCT/EP2003/012740, dated Jun. 16, 2005.

Examination Report on corresponding German application DE 102 53 136.6, dated Sep. 3, 2003.

* cited by examiner

*Primary Examiner*—Mark T Le
(74) *Attorney, Agent, or Firm*—Hooker & Habib, P.C.

(57) ABSTRACT

The invention relates to a support (1) for functional planes used for a magnetic levitation track. The stator packets (11) comprised in the track are suspended in a particularly compact and production-friendly manner on a stator beam (9), the stator packet being connected to the stator beam (9, 10) via borings (15) that are disposed therein and holding bolts (16, 38) which penetrate said borings (15). The stator packets (11) can be secured in a redundant manner vial additional suspensions (30, . . . , 34) and/or by creating a non-positive connection between adjacent stator packets (11) by providing the faces of the stator packets (11), which face the direction of travel, with a profile.

18 Claims, 4 Drawing Sheets

SUPPORT FOR FUNCTIONAL PLANES

FIELD OF THE INVENTION

The invention concerns a functional plane beam for a travelway for a magnetically levitated vehicle. Such a travelway is constructed of track supporting members, which consist of a main beam, which is inserted between two functional plane beams. Accordingly, on this account, the said functional plane beam defines the travelway, i.e. the course of the magnetically levitated railway or, in yet other words, a fast magnetic train track.

BACKGROUND OF THE INVENTION

The fast magnetic train tracks forms a system of bearing, guidance and drive, all of which is in a non-touching mode. Employed is a longitudinal stator-linear motor, which is based on the principle of electromagnetically levitated. The long-stator linear motor corresponds, in this application, to an electric motor, with a winding in the direction of travel. Instead of a magnetically rotating field, the linear motor generates an electromagnetic field, which proceeds along the length of the entire travelway. With the aid of an electronic control system, the magnetically levitated vehicle hovers some 10 mm above the upper surface of the travelway. By a reversal of the magnetic field, the vehicle can be braked without contact or accelerated. In this operation, a principle component of the drive, specifically the stator packet, is built into the travelway. For the receiving of the said stator packet, the functional plane beam is entrusted to take over the main operations of carrying, guiding and lifting of the vehicle. Additionally, the functional plane beam conducts all operational loads, for example, through connection consoles on the main beam, which, in turn, conduct the loads into the ground by means of underpinnings and the foundations.

FIG. 5 shows a conventional functional plane beam 110. The functional plane beam possesses, to fulfill its expectations, a slide-surface 112 which faces upward, upon which the magnetically levitated vehicle can slide, if the drive, that is the current supply, drops out completely. In this case, the magnetically levitated vehicle supports itself on special sliding elements to match the said slide surface and glides along until it comes to a standstill. Lateral guide flanges 114, having active surfaces running in the travel direction and aligned perpendicularly to the said slide surface serve for the side-to-side guidance of the magnetically levitated vehicle. This guidance takes place by directive magnets in guide shoes of the magnetically levitated vehicle, which shoes are carried adjacent to the said lateral guide flanges.

In the lower area of the functional plane beam are placed the stator packets 116, which lift and drive the vehicle. These packets are so arranged, that they lift the vehicle by means of a base group of magnets set within the guide shoes, wherein they pull the magnets. Since, in this area, only the smallest possible clearances can be allowed, the stator packets and consequently the functional plane beams themselves are especially aligned and secured.

Finally, the functional plane beam itself is adjusted and fastened on a mounting surface facing the main beam. Although, steel has proven itself, because of tolerance reasons, in the case of the functional plane beam, it is possible that the therefrom separated main beam can be made just as well out of concrete (hybrid beam construction) as out of steel.

For a means of suspension to retain the stator packet, the suspension system shown in DE 19 735 471 has had a successful history. This suspension system provides the stator packet to be encapsulated in plastic and to be furnished with horizontal, T-shaped grooves running transversely to the direction of travel. Further, the functional plane beam possesses a so-called stator carrying member, which, on its under side has two, parallel, trapezoidal bars (traverses) running in the direction of travel, which, likewise, possess the said horizontal T-grooves running transversely to the direction of travel. The said grooves are set at the same distances apart as are those of the stator packets.

Although the said grooves were placed in the stator packets during its manufacture, because the individual metal sheets, from which the stator packets are formed, are subjected to stampings for the grooves, the other grooves in the stator carrying member are machine-milled in accord with the desired positioning of the stator packets. The coupling between the stator packet and the stator carrying member is done by groove matching, since the grooves of the carrying members possess the same profiling as that of the packet T-grooving. In this way the grooves complementarily join and both the components, namely the stator and the stator carrier bind together in a defined position. In this way, the groove fitting is additionally secured by screw connection to the functional plane beam.

Another stator carrier suspension has been made known by DE 19 931 367, in which the groove traverse, which is bound to the stator packet, is placed between two parallel web flanges, which are located on the underside of the stator carrier member and are screwed thereto. An additional security is achieved here by means of set-pins, which are placed parallel to the said screw connections.

The purpose of the securities of the two above described stator suspensions lies therein, in that upon a failure of the fastening means, a defined and detectable vertical displacement of the stator packet can be allowed, so that the utilization of the travelway continues to be possible and the suspension damage can be localized. This can be, for example, be executed in correspondence with properly distributed sensors along the travelway.

The principal disadvantage of this much employed solution can be found in the fact that, the fastening of the stator packet by groove traverse members or by other intervening pieces onto a stator carrier member is relatively complicated to mechanically carry out and to maintain. Disadvantageous in this matter also, is that the useable stator height is considerably reduced by any such intervening elements.

This becomes especially of importance, in occasions wherein for the purpose of acceleration a high current demand must be called up to load the stator windings. The strength of the current, however, is limited by the available cross-section of the electrical conductor wires and the therewith accompanying increase in temperature. Too high a current would lead to an overheating of the system. Larger conductor cross-sections, however, are not possible, because of the limited height of the stator packets. Stator packets of a larger overall height can only be installed under such circumstances wherein the profile of the functional plane beam would be correspondingly increased. Such a change would be encumbered with substantial design alterations—even including the guide shoe of the vehicle itself. Further, the employment of materials, which are resistant to higher temperatures, is subjected to limitation on both technical and economic grounds.

SUMMARY OF THE INVENTION

The purpose of the present invention is, to make available a functional plane beam, which can accept a larger stator packet, that is a stator packet with a higher capacity. Under these circumstances, further advantages can be seen, such as simplification of the suspension, the mounting, and the alignment of the stator packet and as well the disadvantages of design of the conventional functional plane beam can, at least, be compensated for.

The achievement of this purpose is carried out by a functional plane beam having a stator beam which carries a stator packet. The stator packet consists of vertical and travel-directed stator lamellas, and a boring penetrating the lamellas essentially perpendicular to the lamellas' vertical alignment. The stator packet is bound together by a holding unit, which holding unit in a preferred embodiment includes a penetrating bolt on the stator.

The concept therein is, to incorporate the suspension of the stator packet directly within the stator body itself. In this way, it becomes possible to completely use the stator package itself to completely fill the available space between the upper surface of the stator and the underside of the stator beam, which latter can theoretically extend itself as far as the slide surface. Even using the available space conventionally allowed by the present system, there are now stator packets available, wherein, in place of only one stator winding, two stator windings are incorporated.

Thereby it becomes possible that higher acceleration values can be attained, without the disadvantage that greater or more complex stator windings are necessary. Further, it is possible that the acceleration period can be shortened, and possible upward climbs of the travelway can by increased, so that the travelway contours can more nearly approximate an existing land profile. This latter can also lead to a simplification of the construction of the trackage.

In an embodiment of the invention the stator packet is held together by clamping plates. Such stator packets are less expensive to manufacture, since they have lesser demand for sealing. In this matter, the holding piece itself can serve to dissipate the connective forces.

The clamping force can be transferred to the clamping plates by clamping elements placed on the connection piece. The clamping elements can be a shell or sleeve running coaxially with the connection piece and penetrating the stator packet and the clamping plates. The sleeve, first, picks up the clamping forces between the clamping plates, and second, serves as an encapsulation for the holding unit or penetrating connection piece (hereinafter, referred to a "bolt").

The sleeve makes possible a refined adjustment of the stator packet, namely, of the stator beam by which the final boring geometry of the sleeve itself in its adjusted condition is determined, so that an exact positional fixation can be made by the said bolt.

The bolt, at assembly, can form a compression bonding with the sleeve, stator packet, and clamping plates. It becomes possible that the stator packet or the stator beam can be completely affixed by force fit.

The stator packet can include recesses for the stator windings, and projections between the stator windings. The stator packet can possess additional clamping elements in the area of the projections between the recesses. In the case of deeply made recesses for the stator windings, an outspreading of the stator sheet metal is prevented.

In possible embodiments the stator beam is constructed as a U-shaped structural member, and the bolt penetrates the two arms thereof. The bolt can form a press-fit with the stator beam, and can engage itself in a slotlike excision in the U-shaped structural member. This provides a particularly simple design of the stator beam, which itself, will be improved thereby.

The bolt can be bound to the functional plane beam by an additional suspension. The additional suspension can be designed to secure the bolt in the bolt's inserted position. A basis for a redundant fastening and/or a security measure is made evident.

In another possible embodiment of the present invention, the functional plane beam can be constructed from essentially two rolled structural shapes. One shape can be a structural angle member which incorporates a slide surface and lateral guide flange. The other shape can be a T-shaped member which carries a mounting surface and the stator beam. The most important functions—namely, carrying, guiding, driving—are thereby integrated into only two core components.

In yet other possible embodiments of the present invention a horizontal groove can be constructed in one end face of the stator packet. The groove runs transverse to the direction of travel. In the other stator packet end face, a horizontal spring or tongue is positioned transverse to the direction of travel. The beam includes a number of sequentially spaced stator packets wherein a tongue is received in the respectively adjacent groove and engages the respectively adjacent stator packet. This provides safety in a case of failure of the double sided support of the stator packet and at the same time enables a detectable, groove width displacement signal, which with the installation of appropriate sensors on the travelway can be localized.

The invention, in the following, is described and explained in greater detail with the aid of figures of one embodiment of the invention.

DESCRIPTION OF THE PREFERRED EMBODIMENT

Figure 1:
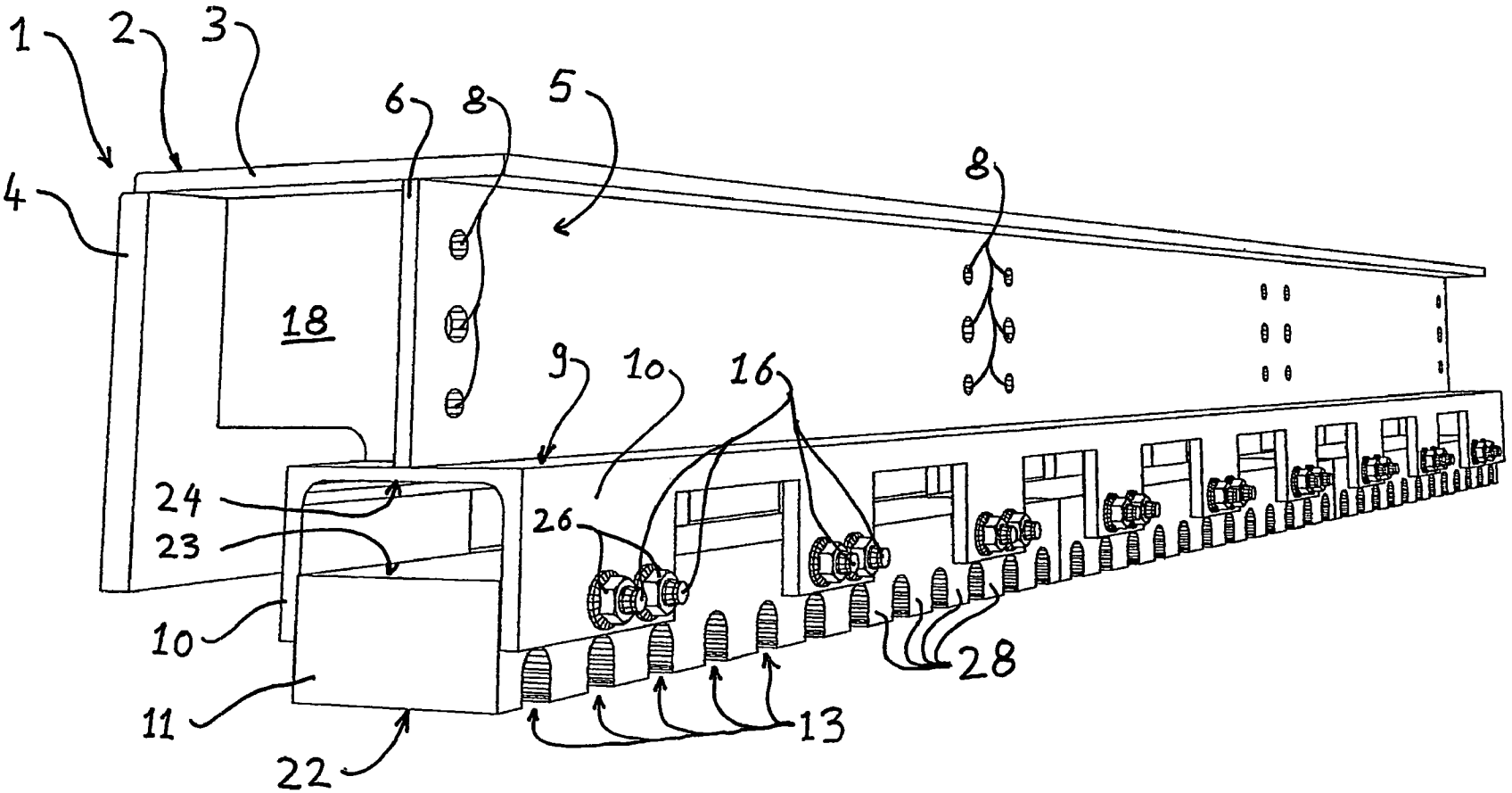
FIG. 1 a perspective view of an invented functional plane beam.

FIG. 1 shows a functional plane beam, assembled by welded construction and possessing an upper flange 3. In turn, the top surface of the upper flange 3 serves as a sliding surface 2, which surface runs horizontally in the direction of travel. On the outer edge of the upper flange 3 is located a vertical lateral guide flange 4, which also runs in the direction of travel. The mounting surface 5 is the face of a vertical flange 6, extending itself parallel to the lateral guide flange 4 and is positioned inward in the travelway assembly. The flange 6 and its mounting surface 5 serve for being coupled to the main beam 7 (see FIG. 3) and are further penetrated by borings for erection purposes. On the under edge of the flange 6, the stator beam 9 is fastened. Stator beam 9 is formed into an inverted U shape, thus having two side walls 10. The said side walls 10 of the stator beam 9 contain a stator packet 11, which is constructed of sheet metal stator laminations 12, vertically aligned, and running in the direction of travel (FIG.

3). The stator laminates 12 are formed by stampings, which, first, define the recesses 13 for stator windings 14 (FIG. 3) and second, provide the location for a boring 15, which penetrates the stator packet in a direction transverse to the direction of travel.

A stator packet 11, as this is depicted in FIG. 1, is formed into a block by adhesive application and encapsulation of the said stator laminate in a plastic pour. Holding units, preferably realized as bolts 16, provide means for fastenings to the stator beam, wherein the said fastenings include screws, threaded bolts, cylindrical pins, positioning pins, and the like. The bolt 16 penetrates the boring 15 of the stator packet 11 as well as the adjacent and corresponding borings 17 in the side flanges 10 of the stator beam 9.

Upper flange 3, vertical flange 6, stator beam 9 and the lateral guide flange 4 are all appropriately welded together. For reinforcement, transversely placed rib plates 18 as well as cross-ties 18*a* are likewise welded in.

Figure 3:
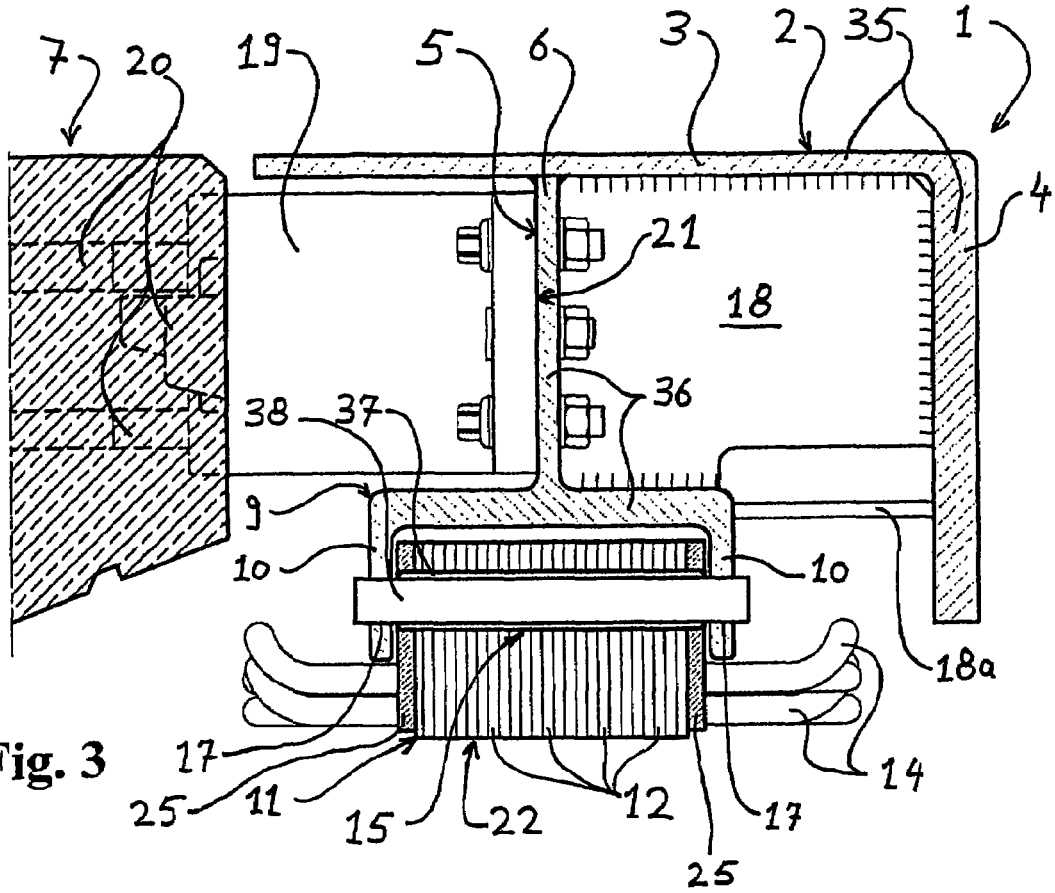

The connection of the complete functional plane beam to the main beam is effected by an adapter piece 19, which, as shown in FIG. 3, is molded into corresponding anchorages 20 in the main beam 7. The said adapter piece 19 can likewise be connected to a main beam 7, in the normal manner of joining structural steel members (not shown).

For the joining of the functional plane beam 1, the outward extending end face 21 of the adaptor piece 19 can be so machined, that upon coupling with the mounting surface 5 of the functional plane beam 1, the travelway for the magnetically levitated vehicle can be constructed with the required precision for the two respective functional plane beams 1 which are installed on each outer side of the main beam 7.

Figure 5:
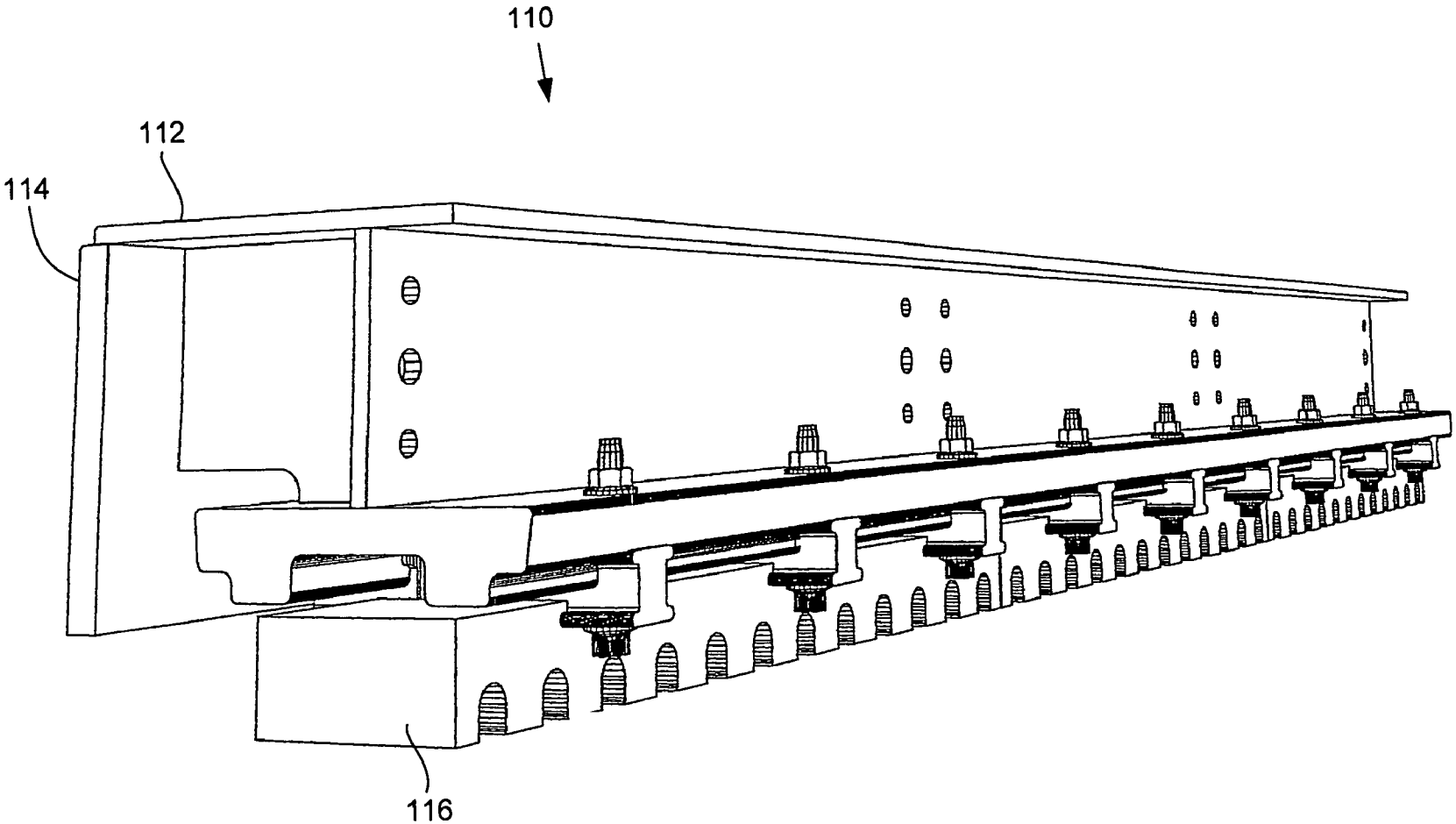
Fig. 5 Prior Art

In the erection procedure, the stator packet 11 is additionally adjusted to the functional plane beam 1, so that the required, especially small clearances, which apply to the active surfaces 22 of the stator packet 11, can be achieved. The embodiment which is shown in FIG. 1, indicates that between the upper side 23 of the stator packet 11 and the underside 24 of the stator beam 9, is to be found an empty space, which exhibits approximately the same free height as this is evident in conventional fastening with the groove traverses (FIG. 5). This empty space can now be employed, in that, the stator packet 11 now fills this space and the bolt 16 is relocated accordingly to the underside 24 of the stator beam 9. The recesses 13 for the stator winding 14 can be inwardly extended more deeply, so that two stator windings 14 can be accepted, without the necessity of changing the profile of the functional plane beam 1. The principle of this arrangement can be inferred from FIGS. 2, 3.

Figure 2:
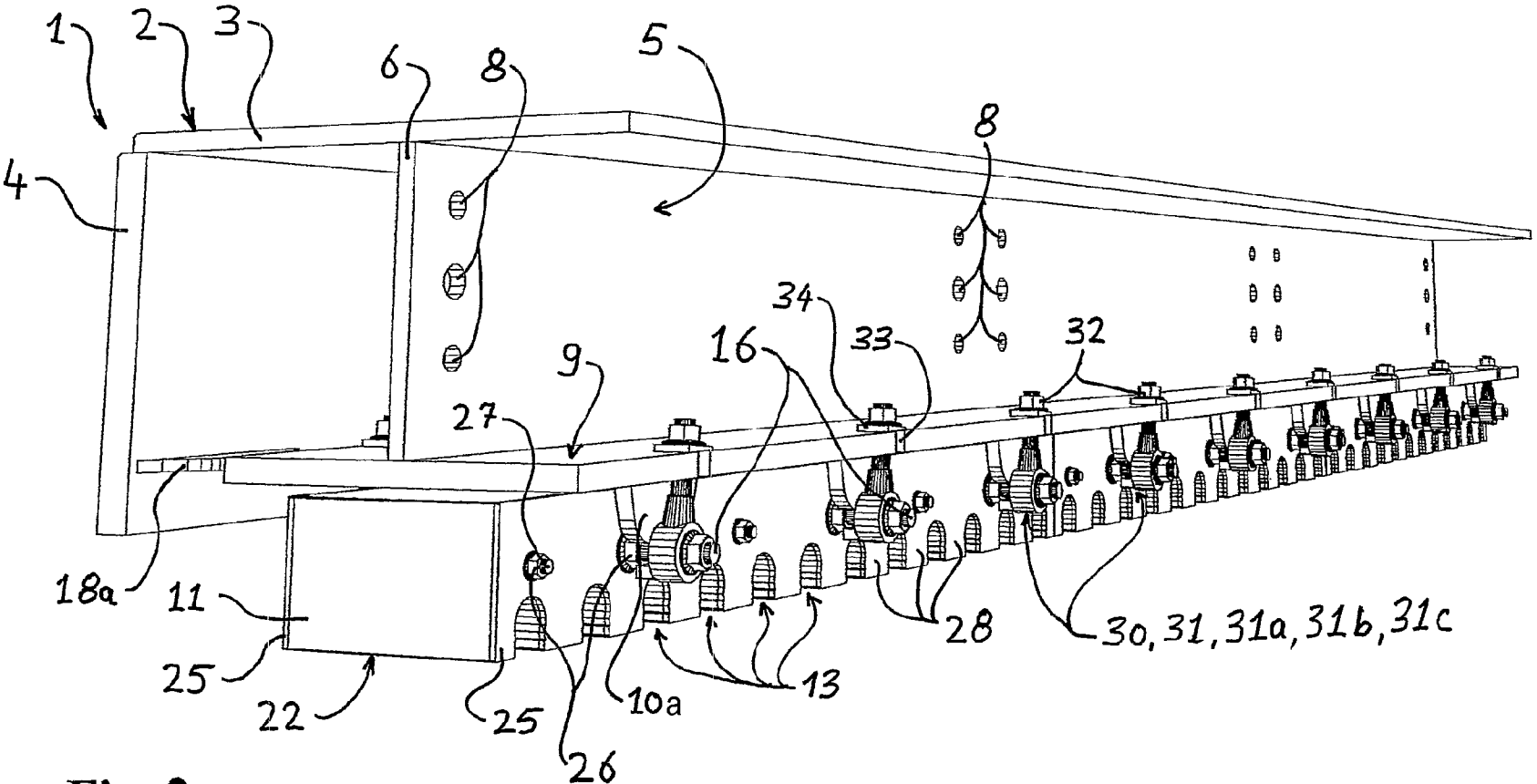
FIG. 2 a perspective view of a functional plane beam with a redundant suspension, FIG. 3 a cross-section through an invented functional plane beam and with a double stator winding, FIG. 4 the groove and spring coupling of the stator packet, presented in direction of travel and FIG. 5 a conventional functional plane beam with a known stator suspension means.

FIG. 2 shows a further developed stator packet 11, wherein the stator laminations 12 are clamped between two clamping plates 25. The said clamping force is brought about by connection elements 26, which base themselves either on the bolt(s) 16, which penetrate the stator packet and the clamping plates or on additional tie bars 27. The said clamping force, in this matter, can also be applied by threaded connections or in other conventional ways.

In the case of the said deepened recesses for the reception of more stator windings 14, the danger, that the laminated sheets of the stator 12 can loosen themselves, in particular in the area of the projections 28 between the recesses 13, is countered in that additional tie bars 27 are installed in these said projecting areas 28.

It is also possible, that clamping elements can be provided (not shown), which function in a clip-like manner, and enclose the projections 28 without projecting themselves out beyond the external surface, but yet do hold the stator lamellas together. These clips can serve simultaneously for the reception and the fixation of the stator windings 14.

The fastening of the stator packet 11 in FIG. 2 is done with the aid of side located consoles 10*a*, which, in common with the stator beam 9, peripherally enclose the stator packet 11 in a U-shaped reception area. The side consoles 10*a* possess, in this function, slit appearing cutouts, into which the corresponding, lengthened bolts 16 can be inserted. Stator packets 11 mounted in this manner can be additionally secured by coupling the bolts to the stator beam 9 by means of suspension elements 30, which, for example, consist of eye-bolts 31. The force direction of these suspension elements 30 is so selected, that it secures the stator packet 11 with the bolt 16 in a specified inserted position. In the embodiment according to FIG. 2, the bolt 16 extends itself into the eye 31*a* and is fastened therein by a nut 32, whereby the screw-winding of the eye-bolt 31*b* engages itself in a slot 33 in the stator beam 9 and is secured there by a wedge 34 and a nut 31*c*. The wedge serves the purpose of exerting a horizontal force-component onto the bolt 16, with which component it fixes the stator packet 11 in a specified position.

FIG. 3 demonstrates an additional embodiment example of an invented functional plane beam 1 wherein the functions are integrated into two main elements 35, 36. The upper flange 3 and the lateral guide flange 4 are combined into a single angle bar 35, while the vertical flange 6 and the stator beam 9 combine, at with the side flanges 10, which said flanges at least partially enclose the stator packet 11, to make a T-shaped, structural member. This T-member can also be made without the side flanges 10. In such a case, the side consoles 10*a* and/or the suspension element 30 (see FIG. 2) can be installed onto the essentially flat stator beam 9. Also, other structural element arrangements are possible. For instance, it is allowable, that upper flange 3, vertical flange 6 and the stator beam 9 can be built-up as a double T-beam (not shown), which is closed by means of the lateral guide flange 4 on that side which forms the travelway edge. For reinforcement with this type of construction, rib plates 18 and cross-ties 18*a* can be installed.

FIG. 3 shows another embodiment of the present invention, which is particularly advantageous. In this example, a stator packet 11 is presented, the lamellas 12 of which, are compressed between two clamping plates 25. The clamping force, in this case, is generated by a shell or sleeve 37 which penetrates the boring 15. The said sleeve 37 is welded at its ends to the clamping plates 25. It is also possible, that the sleeve 37 need be welded only at one end with one clamping plate 25, while the other end, is secured in the other clamping plate 25 by a collar and a corresponding recess which extends in the direction of the boring 15. The suspension of the stator beam 9 is carried out by a bolt 38, which passes through the mounting boring 17 and the sleeve 37. The mounting of the bolt 38 can be done especially simply and safely, in that the said bolt can be refrigerated (for example with liquid nitrogen) and so inserted with reduced dimensions. Following warming to ambient temperature a compressive seating is achieved with the said sleeve 37 as well as the boring 17. By this means, a force fit connection is created between the bolt 38 and the stator beam 9, 10, as well as between the bolt 38 and the sleeve 37. Obviously, no further fastening elements are necessary. Even the operational warming of the stator packet does not loosen the said compressive seating, since the bolt and the stator packet mutually increase in temperature at the same rate.

By means of appropriate structural formation, the sleeve 37 can permit a post-machining of its inner surface, even after the stator packet 11 has been assembled. This is advantageous, because, possibly by abrasion, the stator lamellas are not thereby damaged, and thus following the fine adjustment of the stator packet 11 in its interior placement, the mounting boring 17 and the inner passage through the sleeve 37 can be completed in a single work-operation, and subsequently only the bolts 38 need be run through. When this is done, it is favorable, if both the mounting boring 17 as well as the through passage within the sleeve 37 need be only ground or milled at the ends.

Figure 4:
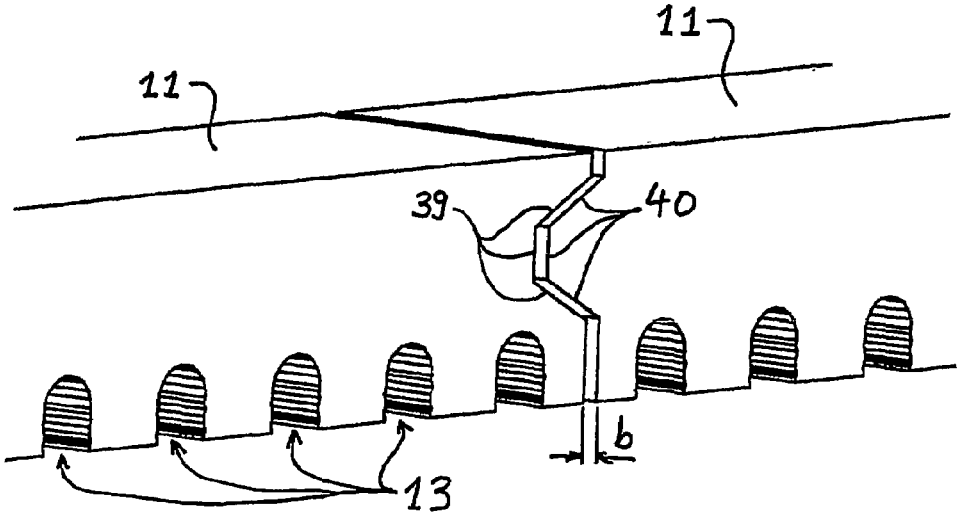

FIG. 4 shows a perspective view of two stator packets 11 arranged sequentially in the direction of travel, which are constructed with a transversely running groove 39 combined with a transversely running spring 40 on the end faces. For better viewing orientation, the recesses 13 for the stator windings are also shown. The receiving borings, the clamping means, and the stator lamellas are not shown. The groove and spring combination between the individual stator packets 11 offers an additional security measure upon a failure of the fastening of a stator packet 11. The concern here is namely the groove 39, i.e., the spring or tongue 40 of the adjacent stator packet 11. A stator packet 11, which suffers a failure of the suspension, must then rely on the vertical component of the width of the fissure b, to be displaced in the functional plane beam 1. This displacement can be detected by appropriate sensors, which then emit a localizing signal, by means of which a defective travelway stretch can be recognized. In the case of this arrangement, a fissure width b between 0.5 and 10 mm has shown itself as particularly advantageous. The geometry of the groove and spring combination is not limited to trapezoidal shaping shown in FIG. 4. It is possible, that any structural element shape could be chosen, which permits a shape fit interference in the vertical movement of stator packets which are adjacent to one another.

The invention claimed is:

1. A functional plane beam (1) for a magnetically levitated travelway having a main beam (7), the functional plane beam extending in a travel direction, the function plane beam comprising:

a mounting surface (5) for coupling the functional plane beam (1) onto the main beam (7), a slide surface (2), a lateral guide flange (4), a stator beam (9, 10, 10*a*), a stator packet (11), a holding unit (16, 38) on the stator beam (9, 10, 10*a*), two clamping plates (25), and a sleeve (37), the stator beam (9, 10, 10*a*) carrying the stator packet (11);

the stator packet (11) comprising vertical and travel directed stator lamellas (12), a boring (15) penetrating the said lamellas (12) essentially perpendicular to their vertical alignment;

the clamping plates (25), running essentially parallel with the stator lamellas (12), the stator packet (11) being pressed together with a specific clamping pressure between the two clamping plates (25), the stator packet (11) bound together by the holding unit (16, 38), the holding unit (16, 38) penetrating said clamping plates (25); and the clamping pressure directed by the sleeve (37) extending coaxially with the holding unit (16, 38), the sleeve (37) penetrating the stator packet (11) and the clamping plates (25).

2. A functional plane beam in accord with claim 1, wherein the holding unit comprises a bolt (16) and a nut (26) threaded onto the bolt.

3. A functional plane beam in accord with claim 1, wherein the sleeve (37) is welded with at least one of the said two clamping plates (25).

4. A functional plane beam in accord with claim 1, wherein the holding unit (16, 18), during the time assembly, forms a compression bonding with the sleve (37), with the stator packet (11) and with the clamping plates (25).

5. A functional plane beam in accord with claim 1 wherein the stator packet (11) comprises recesses (13) for stator windings and projections (28) between the recesses (13), the functional plane beam further comprising tie bars (27), extending through the projections (28).

6. A functional plane beam in accord with claim 1, comprising at least one tie bar extending through the stator packet (11) and the clamping plates (25), the at least one tie bar spaced from the holding unit (16, 38).

7. A functional plane beam in accord with claim 1, wherein the stator beam (91 10, 10*a*) is constructed as a U-shaped structural member, and the holding unit (16, 38) penetrates the two arms (10) thereof.

8. A functional plane beam in accord with claim 7, wherein the holding unit (16, 38) forms a press-fit with the stator beam (9, 10, 10*a*).

9. A functional plane beam in accord with claim 7, wherein the holding unit (16, 38) engages itself in a slotlike excision in the U-shaped structural member (10, 10*a*).

10. A functional plane beam in accord with claim 7, wherein the holding unit (16, 38) is bound to the functional plane beam by an additional suspension (30, 31*a*, 31*b*, 31*c*, 32, 33 34).

11. A functional plane beam in accord with claim 10, wherein the additional suspension (30, 31*a*, 31*b*, 31*c*, 32, 33 34) secures the holding unit (16, 38) in its inserted position.

12. A functional plane beam in accord with claim 1, wherein the functional plane beam (1) is constructed from essentially two rolled structural shapes (351 36), in particular incorporating a structural angle member (35) which incorporates the slide surface (2) and the lateral guide flange (4) as well as a T-shaped member (36), which carries the mounting surface (5) and the stator beam (9, 10).

13. A functional plane beam in accord with claim 1 comprising a plurality of stator packets (11) spaced along the direction of travel, wherein each stator packet (11) comprises opposite end faces, a horizontal groove (39) running transverse to the direction of travel formed in one end face and a tongue (40) running transverse to the direction of travel formed in the opposite end face thereof, the tongues (40) of the stator packets (11) extending into the grooves (39) of adjacent stator packets (11) such that the tongues (40) and grooves (39) cooperatively define tongue-and-groove joints resisting vertical movement of the stator packets.

14. A functional plane beam in accord with claim 13, wherein the groove (39) and the tongue (40) of each tongue-and-groove joint is separated by a width b, said width b being between 0.5 and 10 mm.

15. A functional plane beam in accord with claim 1, wherein the holding unit comprises a bolt penetrating the clamping plates (25).

16. A functional plane beam in accord with claim 1, wherein the stator beam (9, 10, 10*a*) is constructed as a U-shaped structural member, and the holding unit comprises a bolt penetrating the two arms of the structural member.

17. A functional plane beam in accord with claim 16, wherein the bolt forms a press-fit with the stator beam (9, 10, 10*a*).

18. A functional plane beam in accord with claim 16, wherein the bolt extends into a slotlike excision in the U-shaped structural member (10, 10*a*). U-shaped structural member (10, 10*a*).

* * * * *

UNITED STATES PATENT AND TRADEMARK OFFICE

CERTIFICATE OF CORRECTION

PATENT NO. : 7,401,557 B2
APPLICATION NO. : 10/534527
DATED : July 22, 2008
INVENTOR(S) : Feix et al.

It is certified that error appears in the above-identified patent and that said Letters Patent is hereby corrected as shown below:

In the Claims:

Column 7, line 60 claim 4, insert --of-- between “time” and “assembly”.

Column 8, line 11, replace “91” with --9,--.

Column 8, line 29 claim 12, replace “351” with --35,--.

Column 8, lines 60 and 61 claim 18, delete “U-shaped structural member (10, 10a).”

Signed and Sealed this

Sixteenth Day of September, 2008

JON W. DUDAS
*Director of the United States Patent and Trademark Office*